US006270160B1

(12) United States Patent
Blake

(10) Patent No.: US 6,270,160 B1
(45) Date of Patent: Aug. 7, 2001

(54) HEAD AND NECK SUPPORT

(76) Inventor: Kenneth D. Blake, Rte. 2, Box 723B, Winnfield, LA (US) 74183

( * ) Notice: Subject to any disclaimer, the term of this patent is extended or adjusted under 35 U.S.C. 154(b) by 0 days.

(21) Appl. No.: 09/482,503

(22) Filed: Jan. 13, 2000

Related U.S. Application Data

(60) Provisional application No. 60/115,973, filed on Jan. 15, 1999.

(51) Int. Cl.[7] ..... A47C 7/36

(52) U.S. Cl. ..... 297/393; 297/408; 297/410

(58) Field of Search ..... 297/391, 392, 297/393, 397, 408, 410, 4; 108/6, 50.14, 144.11, 147.21; 248/118, 118.1, 118.3, 118.5, 157

(56) References Cited

U.S. PATENT DOCUMENTS

| | | | | |
|---|---|---|---|---|
| 689,758 | * | 12/1901 | Shaw . | |
| 1,155,223 | | 9/1915 | Douglass . | |
| 1,463,081 | * | 7/1923 | Hancock . | |
| 2,172,178 | * | 9/1939 | Rosenberg . | |
| 2,638,152 | | 5/1953 | Pulsifier . | |
| 2,710,051 | * | 6/1955 | Greenberg . | |
| 3,292,974 | * | 12/1966 | Gelbman . | |
| 3,643,996 | * | 2/1972 | Carnahan . | |
| 4,498,704 | | 2/1985 | Hildreth | 297/397 |
| 4,527,833 | | 7/1985 | Parker | 297/397 |
| 4,619,483 | * | 10/1986 | Dickey et al. . | |
| 4,653,808 | * | 3/1987 | Opsvik . | |
| 4,674,472 | * | 6/1987 | Reis . | |
| 5,308,028 | | 5/1994 | Kornberg | 248/118 |
| 5,720,522 | * | 2/1998 | Habeck . | |

* cited by examiner

*Primary Examiner*—Milton Nelson, Jr.
(74) *Attorney, Agent, or Firm*—John M. Harrison

(57) ABSTRACT

A head and neck support for engaging a leg of a seated person or the arm of a chair and comfortably supporting the head and neck of the person at a selected angle and height above his or her lap. In a preferred embodiment the head and neck support includes a head support tray which typically supports a pillow, upon which the head of the sitting person rests. The head support tray is pivotally and adjustably mounted on a cylindrical compression shaft fitting which adjustably receives the upper end of an extension shaft or a support shaft attached to the extension shaft and terminated on the bottom end by a curved support arm which typically engages the leg of the person. A compression sleeve is provided on the extension or support shaft for threadibly engaging and compressing the compression shaft fitting against the extension shaft or the support shaft after a selected length of the extension shaft or the support shaft is extended from the compression shaft fitting. The head support tray can be adjusted at a selected angle with respect to the support shaft to provide optimum comfort to the user.

8 Claims, 2 Drawing Sheets

HEAD AND NECK SUPPORT

CROSS-REFERENCE TO RELATED APPLICATIONS

This application claims the benefit of U.S. Provisional Application Ser. No. 60,115,973, filed Jan. 15, 1999.

BACKGROUND OF THE INVENTION

1. Field of the Invention

This invention relates to headrests and more particularly, to a head and neck support for typically engaging a leg of a seated person or the arm of a chair and supporting the head and neck of the person at a comfortable angle and at a selected height above his or her lap. In a preferred embodiment the head and neck support includes a head support tray for typically supporting a pillow which receives the head of the sitting person. The head support tray is pivotally and adjustably attached to a cylindrical compression shaft fitting which receives the upper end of an extension shaft or a support shaft terminated on the bottom end by a curved support arm which typically engages the leg of the user. The extension shaft or support shaft initially receives a compression sleeve which is threaded on the compression shaft fitting to compress the compression shaft fitting against the extension shaft or the support shaft and secure the extension shaft or the support shaft in the compression shaft fitting after a selected length of the support shaft or the extension shaft is extended from the compression shaft fitting. The head support tray can be adjusted at a selected angle with respect to the extension and/or the support shaft to provide optimum comfort to the user.

2. Description of the Prior Art

Various types of headrests are known in the art for supporting a person's head while the person sits in a chair during traveling, resting or while the person sits in a wheelchair, for t example. U.S. Pat. No. 1,155,223, dated Sep. 28, 1915, to S. E. Douglass, details a "Head Rest" characterized by spring metal clips which are removably fitted over the armrests of a passenger seat in a train, for example, and a support panel spans the clips on the opposite armrests to allow a person sitting in the seat to rest his or her head and neck on the panel. U.S. Pat. No. 2,638,152, dated May 12, 1953, to Newell Pulsifer, details a "Headrest" characterized by a curved flange which receives the backrest of a chair and a headrest pad extends forwardly from the mounted flange to enable a person sitting in the chair to lean his or her head against the pad. U.S. Pat. No. 3,292,974, dated Dec. 20, 1966, to Nathan L. Gelbman, discloses a "Chair Head Rest" characterized by a vertical support having a forwardly-extending headrest assembly attached thereto and a chair mount hook which is provided on the support beneath the headrest assembly and receives the backrest of a chair. The headrest assembly of the mounted support extends over the backrest and enables a person sitting in the chair to rest the back of his or her head against the padded headrest of the headrest assembly. U.S. Pat. No. 4,498,704, dated Feb. 12, 1985, to Joseph R. Hildreth, discloses a "Headrest For Chair With Soft Backrest" characterized by a U-shaped frame having a padded head support attached to the upper ends of the frame arms. A U-shaped frame extension is adjustably extendible from the bottom end of the frame and the backrest of a chair or wheelchair is inserted between the frame and frame extension to support the headrest on the chair. A "Head Rest Attachment" for tubular frame lawn or patio furniture is disclosed in U.S. Pat. No. 4,527,833, dated Jul. 9, 1985, to James J. Parker. The headrest attachment includes a curved head support and a resilient, adjustable clamp which is provided on the head support and removably receives the tubular backrest of the lawn or patio furniture. U.S. Pat. No. 4,619,483, dated Oct. 28, 1986, to Donna J. Dickey, et al., describes a "Physically Handicapped Shoulder Support For Attachment To A Chair Back", in which a shoulder support panel is attached to the backrest of an armchair or wheelchair. A headrest is provided on the mounted shoulder support panel and a recess is defined in the shoulder support panel beneath the headrest to receive and support a shoulder of a person sitting in the chair and leaning against the shoulder support panel. The headrest is vertically and adjustably mounted on the shoulder support panel to accommodate varying shoulder heights of persons using the chair. U.S. Pat. No. 5,308,028, dated May 3, 1994, to Gary Komberg, discloses a "Headrest Support For A Wheelchair" including a horizontal frame member provided with a pair of spacer blocks at the respective ends of the horizontal frame member for mounting the headrest support to the backrest of the wheelchair. A pair of laterally-adjustable clamping blocks, each of which supports a vertical frame member, is provided on the horizontal frame member between the spacer blocks. Each vertical frame member supports a horizontal, forwardly-extending support member over the backrest, on the extending ends of which horizontal support members is provided a curved, padded headrest.

An object of this invention is to provide an adjustable head and neck support for comfortably supporting the head and neck of a person above his or her lap while he or she is sitting.

Another object of this invention is to provide a head and neck support which can be pivotally or hingedly and linearly adjusted for maximum comfort to support the head and neck of a seated person.

Still another object of this invention is to provide a head and neck support which comfortably supports a person's head at a selected height and position above the person's lap while the person sits, which head and neck support requires no modification of the chair or other support to achieve the purpose.

Yet another object of this invention is to provide a head and neck support characterized by a vertical support shaft which terminates on the bottom end in a curved support arm for typically engaging a leg of a user as he or she sits in a chair or the like, and a head support tray which can be adjusted angularly and vertically on the support shaft or a shaft extension, to comfortably support the head and neck of the user at a selected angle and height above his or her lap.

A still further object of this invention is to provide a head and neck support characterized by a head support tray having a cylindrical compression shaft fitting pivotally or hingedly attached to the underside of the head support tray, with the head support tray typically angularly adjustable with respect to the compression shaft fitting; a support shaft extension or support shaft which are adjustably extendible from the bottom end of the compression shaft fitting; a compression sleeve fitted on the shaft extension or the support shaft for threadibly engaging and compressing the compression shaft fitting against the extension or the support shaft after a selected length of the extension or the support shaft is extended from the compression shaft fitting; and a curved support arm terminating the bottom end of the support shaft for typically engaging the user's leg as the user sits and the head support tray comfortably supports the user's head and neck at a selected height and angle above his or her lap.

SUMMARY OF THE INVENTION

These and other objects of the invention are provided in a head and neck support for comfortably supporting the head and neck of a person at a selected height and angle above the person's lap as the person sits on a supporting surface, typically in a chair or wheelchair. In a preferred embodiment the head and neck support is characterized by a head support tray for typically receiving a pillow, upon which the head of the sitting person rests; a cylindrical compression shaft fitting pivotally or hingedly attached to the underside of the head support tray to provide angular adjustment of the head support tray with respect to the compression shaft fitting and the bottom end of which slidably receives the upper end of a shaft extension or a vertical support shaft; a compression sleeve fitted on the shaft extension or the support shaft for threadibly engaging and compressing the compression shaft fitting against the shaft extension or support shaft after a selected length of the shaft extension or support shaft is extended from the compression shaft fitting; and a curved support arm provided on the bottom end of the support shaft for typically engaging a leg of the person as the person sits, wherein the head support tray comfortably supports the person's head and neck at a selected height and angle above his or her lap.

BRIEF DESCRIPTION OF THE DRAWINGS

The invention will be better understood by reference to the accompanying drawings, wherein.

DESCRIPTION OF THE PREFERRED EMBODIMENTS

Figure 1:
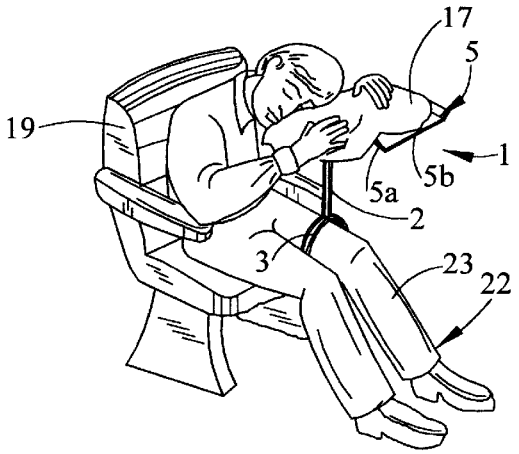
FIG. 1 is a perspective view of a preferred embodiment of the head and neck support of this invention illustrated in functional position supporting the head and neck of a person as the person sits in an armchair.
Figure 2:
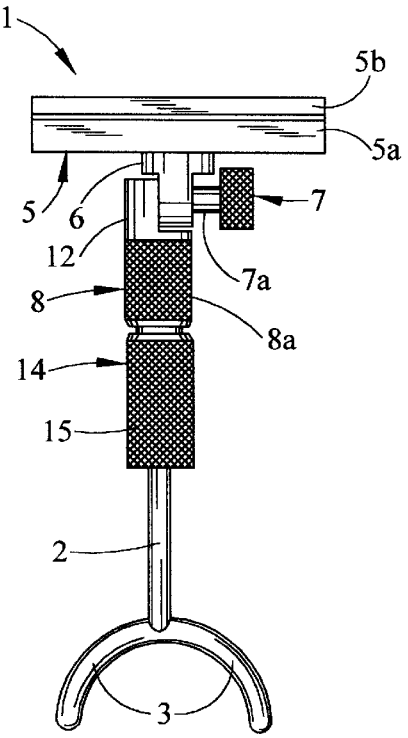
FIG. 2 is a front elevation of the head and neck support illustrated in FIG. 1.
Figure 3:
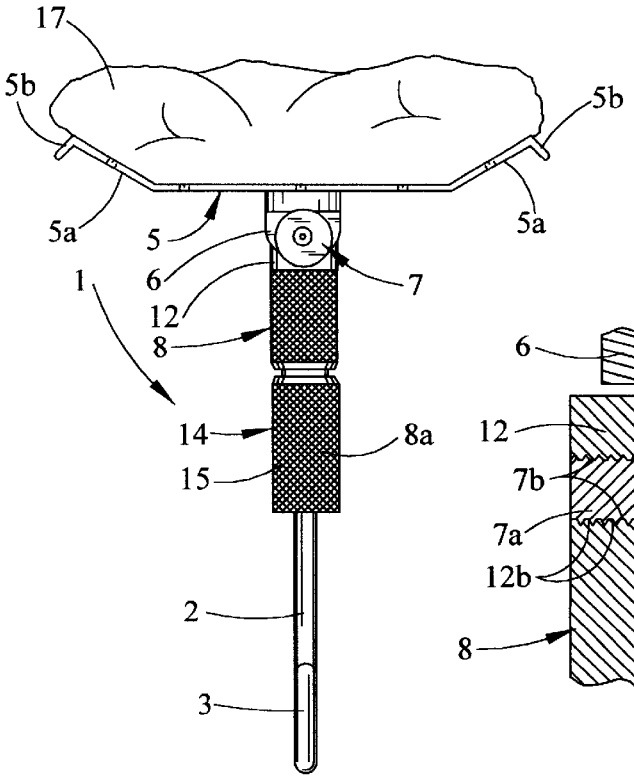
FIG. 3 is a side elevation of the head and neck support illustrated in FIGS. 1 and 2.
Figure 4:
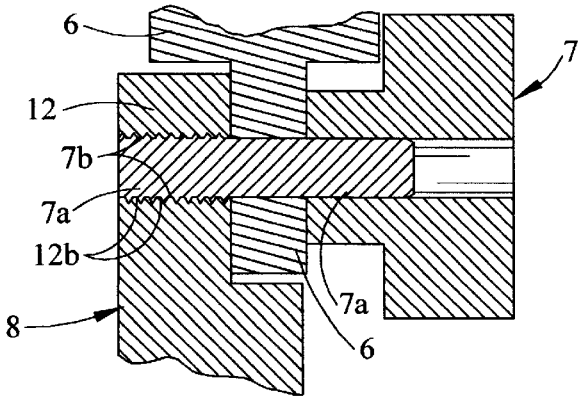
FIG. 4 is a sectional view of the head and neck support, more particularly illustrating a preferred adjustment knob mechanism for pivotally or hingedly and adjustably mounting the head support tray component of the head and neck support on the compression shaft fitting component.
Figure 5:
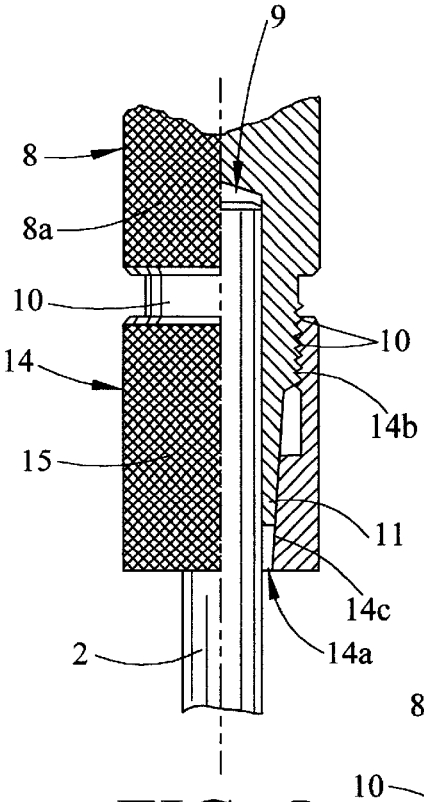
FIG. 5 is a sectional view of the head and neck support, more particularly detailing a preferred compression fitting mechanism for facilitating adjustable extension of a support shaft or shaft extension component into and from the compression shaft fitting element.
Figure 6:
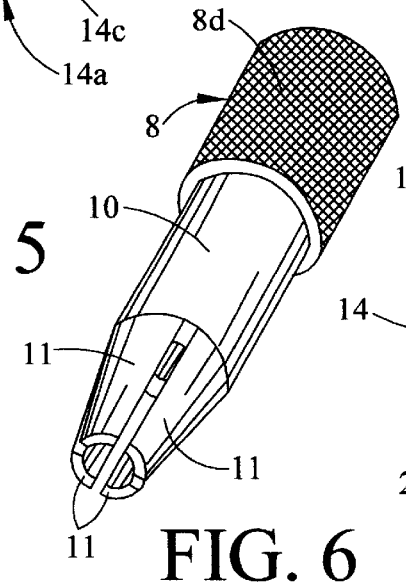
FIG. 6 is an exploded view, partially in section, of the compression shaft fitting, compression sleeve and support shaft components of the head and neck support.
Figure 7:
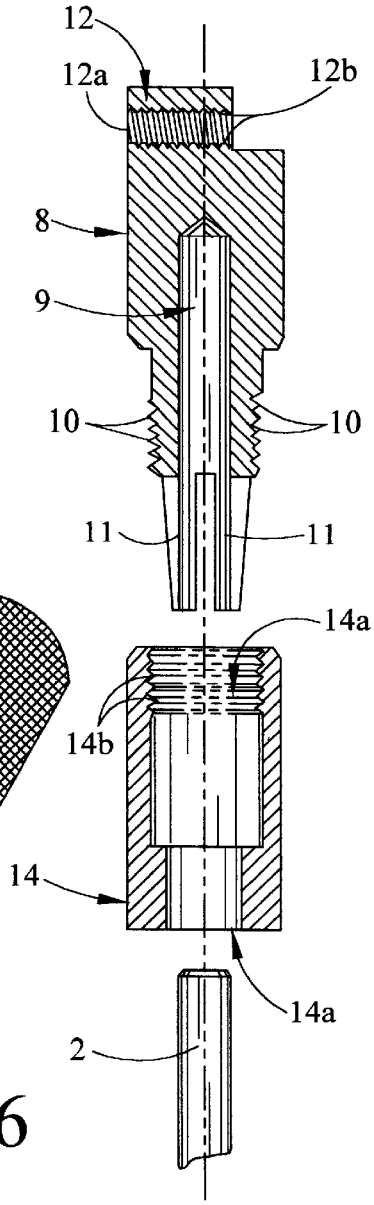
FIG. 7 is a perspective view of the compression shaft fitting component of the head and neck support.
Figure 8:
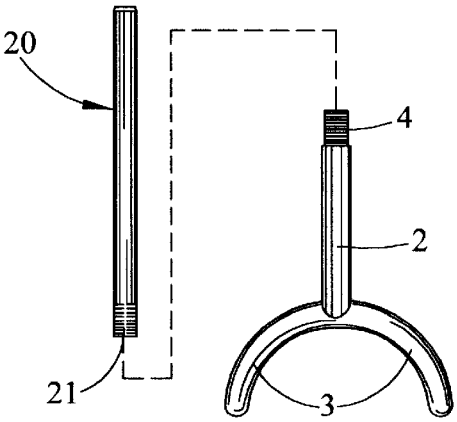
FIG. 8 is a side view of a shaft extension embodiment of the head and neck support of this invention.

Referring initially to FIGS. 1–7 of the drawings, in a preferred embodiment the head and neck support of this invention is generally illustrated by reference numeral 1. The head and neck support 1, assembled from typically aluminum components, includes an elongated head support tray 5 having a pair of sloped tray ends 5*a*, each typically provided with a tray flange 5*b* shaped in opposite transverse edges thereof, as illustrated in FIG. 3. A tray mount flange 6 is provided on the bottom surface of the head support tray 5. As illustrated in FIG. 4, the threaded knob shaft 7*a* of a knurled tray adjustment knob 7 is extended through a flange opening (not illustrated) provided in the tray mount flange 6 and threaded into a flange opening 12*a* (FIG. 6) extending through the adjacent compression fitting flange 12 of a cylindrical compression shaft fitting 8. Shaft threads 7*b* provided on the knob shaft 7*a* engaging flange threads 12*b*, provided in the flange opening 12*a*, to facilitate angular adjustment of the head support tray 5 on the compression shaft fitting 8, as hereinafter further described. The compression shaft fitting 8, typically provided with a knurled grip surface 8*a*, is fitted with exterior compression fitting threads 10 and is terminated on the bottom end by multiple compression splines 11, as illustrated in FIGS. 6 and 7. A central shaft bore 9 is provided in the compression shaft fitting 8 for receiving the upper end of a support shaft 2 (FIG. 2) or a shaft extension 20 (FIG. 8), the bottom end of which support shaft 2 is terminated by a curved, outwardly-extending support arm 3, as illustrated in FIG. 2. As illustrated in FIGS. 5 and 6, before projection into the shaft bore 9 of the compression shaft fitting 8, the upper end of the support shaft 2 (FIG. 2) or the shaft extension 20 (FIG. 8) is inserted through the central sleeve bore 14*a* of a cylindrical compression sleeve 14, typically having a knurled sleeve surface 15 (FIG. 5). As further illustrated in FIG. 6, the sleeve bore 14*a* of the compression sleeve 14 is provided with interior sleeve threads 14*b* in the upper end thereof and a tapered sleeve wall 14*c* in the bottom end of the sleeve bore 14*a*. Accordingly, in typical application of the head and neck support 1 as illustrated in FIG. 5 and as hereinafter further described, a selected length of the support shaft 2 (or the shaft extension 20 illustrated in FIG. 8) is extended through the compression sleeve 14, into the shaft bore 9 of the compression shaft fitting 8, as the sleeve bore 14*a* of the compression sleeve 14 receives the compression splines 11 of the compression shaft fitting 8. As the compression sleeve 14 is rotated and the interior sleeve threads 14*b* of the compression sleeve 14 caused to engage the exterior compression fitting threads 10 of the compression shaft fitting 8, the tapered sleeve wall 14*c* in the sleeve bore 14*a* is progressively extended against the slotted compression splines 11 of the compression shaft fitting 8. Consequently, the tapered sleeve wall 14*c* compresses the compression splines 11 against the shaft extension 20 or the support shaft 2 and secures the support shaft 2 or shaft extension 20 in a selected fixed relationship in the compression shaft fitting 8, as hereinafter further described.

Referring next to FIG. 1 and again to FIGS. 3–6 of the drawings, in typical application of the head and neck support 1, the curved support arm 3 provided on the bottom end of the support shaft 2 initially engages the leg 23 of a person 22 shown in FIG. 1, sitting in a seat or chair 19. The compression sleeve 14 is initially unthreaded on or from the compression shaft fitting 8, thus disengaging the tapered sleeve wall 14*c* from the compression splines 11 and the compression splines 11 from the shaft extension 20 or the support shaft 2. A selected length of the loosened support shaft 2 or the shaft extension 20 is then extended from the shaft bore 9 of the compression shaft fitting 8, according to the desired height of the attached head support tray 5 above the leg 23 of the person 22. The interior sleeve threads 14*b* of the compression sleeve 14 are then caused to re-engage the exterior compression fitting threads 10 of the compression shaft fitting 8 by tightening the compression sleeve 14 on the compression shaft fitting 8 in the opposite direction, to progressively tighten the tapered sleeve wall 14*c* of the sleeve bore 14*a* against the compression splines 11 of the compression shaft fitting 8 and compress the compression splines 11 against the shaft extension 20 or the support shaft 2. The angle of the head support tray 5 with respect to the attached underlying compression shaft fitting 8 and fixed support shaft 2 is then adjusted, as desired, by loosening the knurled tray adjustment knob 7, pivoting the head support tray 5 and tray mount flange 6 with respect to the compression fitting flange 12 and then tightening the tray attachment knob 7 against the tray mount flange 6, to compress the tray mount flange 6 between the compression fitting flange 12 and tray attachment knob 7. As illustrated in FIGS. 1 and 3, a pillow 17 is typically placed on the head support tray 5 between the tray ends 5*a* to receive the head of the person 22 as the person's head and neck are supported by the head support tray 5. As further illustrated in FIG. 8, under circumstances where the shaft extension 20 is needed, support shaft threads 4 may be provided on the extending end of the support shaft 2 and caused to engage the internal extension threads 21, in one end of the shaft extension 20.

It will be appreciated by those skilled in the art that the head and neck support 1 of this invention is lightweight and easy to use by persons of all ages while the person sits in a seat or chair 19 (FIG. 1) of any design or a wheelchair (not illustrated), for example, and the device can be easily disassembled, as desired, for storage. Disassembly of the head and neck support 1 is accomplished by loosening or unthreading the tray adjustment knob 7 from the flange opening 12*a* of the compression fitting flange 12, separating the tray mount flange 6 from the compression fitting flange 12, loosening or unthreading the compression sleeve 14 from the compression shaft fitting 8 and removing the extension 20 or the support shaft 2 from the shaft bore 9 of the compression shaft fitting 8.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A head and neck support for supporting the head and neck of a person above a supporting surface while the person sits in a chair, said head and neck support comprising a compression shaft fitting; a head support pivotally and adjustably mounted on said compression shaft fitting for receiving the head of the person; a support shaft adjustably extendible from said compression shaft fitting and a compression sleeve provided on said support shaft for engaging and compressing said compression shaft fitting against said support shaft; and an engaging mechanism provided on said support shaft for engaging the supporting surface.

2. The head and neck support of claim 1 wherein said head support comprises a head support tray.

3. The head and neck support of claim 2 wherein said engaging mechanism comprises a support arm terminating said support shaft for engaging the supporting surface.

4. A head and neck support for supporting the head and neck of a person above the person's lap while the person sits in a chair, said head and neck support comprising a compression shaft fitting; a head support tray pivotally and adjustably attached to said compression shaft fitting for receiving the head of the person; a support shaft adjustably extendible from said compression shaft fitting and a compression sleeve provided on said support shaft for engaging and compressing said compression shaft fitting against said support shaft; and a curved support arm terminating said support shaft for engaging a leg of the person.

5. A head and neck support for supporting the head and neck of a person above a supporting surface, said head and neck support comprising a head support for receiving the head of the person; a shaft extension for removably and adjustably engaging said head support; a shaft for removably engaging said shaft extension and supporting said head support above the supporting surface when said shaft extension adjustably engages said head support, said shaft adapted for adjustably engaging said head support and supporting said head support above the supporting surface when said shaft extension is removed from said head support; and an engaging mechanism provided on said shaft for engaging the supporting surface, wherein said head support is angularly adjustable with respect to said shaft extension for supporting the head and neck of the person at a selected angle with respect to said shaft extension and said head support is vertically adjustable on said shaft extension when said shaft extension engages said head support, and said head support is angularly adjustable with respect to said shaft and vertically adjustable on said shaft when said shaft engages said head support.

6. The head and neck support of claim 5 wherein said head support comprises a head support tray.

7. The head and neck support of claim 5 wherein said engaging mechanicm comprises a support arm terminating said shaft for engaging the supporting surface.

8. The head and neck support of claim 5 wherein said head support comprises a head support tray and said engaging mechanism comprises a support arm terminating said shaft for engaging the supporting surface.

* * * * *